United States Patent [19]

Schultz

[11] 4,284,230

[45] Aug. 18, 1981

[54] MAILING ASSEMBLY INCORPORATING PLURAL OFFER SEND AND RETURN MAILING PIECES

[76] Inventor: Frank L. Schultz, 100 N. Tower Rd., Alamo, Tex. 78516

[21] Appl. No.: 114,325

[22] Filed: Jan. 22, 1980

[51] Int. Cl.[3] ..... B65D 27/06

[52] U.S. Cl. ..... 229/73; 229/72; 229/92.1

[58] Field of Search ..... 229/72, 73, 92.1, 92.3, 229/92.5, 92.7

[56] References Cited

U.S. PATENT DOCUMENTS

| | | | |
|---|---|---|---|
| 604,722 | 5/1898 | Carter | 229/73 |
| 755,159 | 3/1904 | Morton | 229/92.1 X |
| 1,151,442 | 8/1915 | Crull | 229/73 |
| 1,995,183 | 3/1935 | Kornat | 229/73 |
| 2,071,623 | 2/1937 | Giordano | 229/73 X |
| 2,568,786 | 9/1951 | Boling | 229/72 |
| 2,580,886 | 1/1952 | Broudy | 229/72 |
| 2,867,373 | 1/1959 | Kaufmann | 229/73 |
| 3,131,854 | 5/1964 | Deutschmeister | 229/73 |
| 3,167,243 | 1/1965 | Wiley | 229/73 |
| 3,229,893 | 1/1966 | Stein | 229/68 |

*Primary Examiner*—Stephen P. Garbe
*Attorney, Agent, or Firm*—Glenn E. Wise

[57] ABSTRACT

Plural offer send and return mailing pieces are initially joined together in a mailing assembly for mailing from sender to receiver, but can be quickly separated into plural independent mailing pieces for remailing to one or more destinations.

11 Claims, 8 Drawing Figures

MAILING ASSEMBLY INCORPORATING PLURAL OFFER SEND AND RETURN MAILING PIECES

This invention relates to a mailing assembly, and, more particularly, to a mailing assembly which incorporates plural offer send and return mailing pieces of the type sometimes called self mailers or self-return mailers by those skilled in the art.

Send and return, or self mailer type mailing pieces are commonly used in both social and commercial mailing situations wherein a sender desires an answer or order from the recipient of a mailing piece. Such mailing pieces are particularly useful for use in direct mail selling since an offer or solicitation and an acceptance or order can be incorporated in a single mailing piece. Although my mailing assembly may be utilized in various social and commercial mailing situations, it is particularly useful in direct mail selling because of unique features to be described hereinafter.

Known send and return or self mailer type mailing pieces utilized in direct mail selling are generally of two varieties. The first variety comprises a larger sending envelope in which is placed and mailed to a recipient a smaller return envelope along with various offer or solicitation and order materials. The sender using this variety of mailing piece relies on the recipient to place the completed order form in the smaller envelope and mail same back to him.

The second variety comprises a mailing piece which when mailed by the sender is of unitary, folded, single blank construction having portions thereof designed to form offer or solicitation, order, outgoing address and addressed return envelope means. This second variety either relies on a recipient of the mailing piece to cut or tear portions of the blank apart to assemble the order in the return envelope for remailing to the sender, or requires manipulation of the as-received mailing piece to a different configuration than that in which it was received preparatory to remailing it to the sender.

Although attempts have been made to incorporate plural offers and order forms from diverse sellers in self mailer mailing pieces of the first variety described, the necessity for providing the required solicitation and order forms plus plural smaller return envelopes all within the larger sending envelope produces a rather heavy mailing piece which is relatively costly to mail and which judging from selling results achieved, have not been very successful commercially.

The second variety of self mailer described above, to my knowledge, has not been utilized for conveying plural offers and order forms from diverse sellers to a recipient with subsequent return of one or more of the orders to one or more of the sellers because, until this invention, no mailing piece of this variety had been designed which was capable of such use. It should be noted at this point that the diverse sellers mentioned above are often located at widely separated geographical points, and also that they may be offering for sale completely unrelated goods or services.

I have now devised a single blank mailing assembly of the second variety just discussed which is capable of being used for transmitting plural diverse offers from diverse sellers to a recipient and which is further capable of being used for transmitting plural diverse orders from the recipient to diverse sellers. I have also devised another embodiment which can be utilized in a similar manner to the embodiment just described, but which comprises two separate blanks or pieces each including offer, order and envelope portions, which are joined into a unitary assembly prior to mailing to a recipient.

One object of my invention is to provide a mailing assembly incorporating plural offers, plural order forms, and plural return envelopes all of which are initially in a unitary structure.

Another object of my invention is to provide a plural offer self mailer which is economical to manufacture and simple to use.

Another object of my invention is to provide a self-return mailing assembly which incorporates plural offers and order forms related to different sellers and which further incorporates plural envelopes whereby orders can be returned to such different sellers.

Another object of my invention is to provide novel mailing assemblies which can be used in such manner that the postage costs for mailing same will be minimized.

These and other objects will become apparent as the specification, including the drawings which accompany same, are more fully understood.

Figure 1:
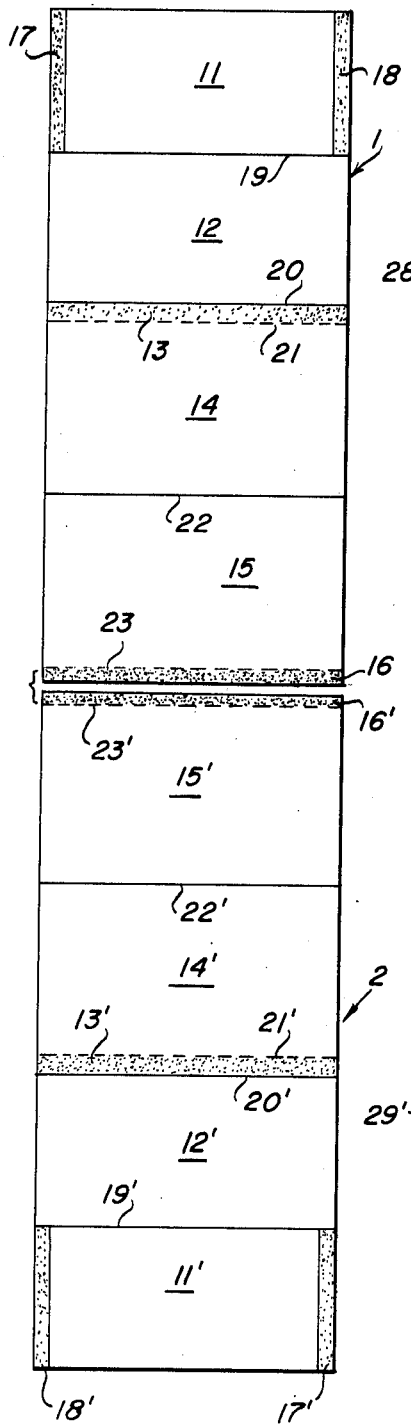
FIG. 1 is a plan view of one side of each of a pair of blanks from which one embodiment of my mailing assembly is made.

Referring now to FIG. 1, one side of each of separate blanks 1 and 2 of a first embodiment of my invention are shown. Blank 1 is comprised of first side portions 11, 12, 13, 14, 15, 16, 17 and 18. Portions 11 and 12 join at a fold line 19. Portions 12 and 13 join at a fold line 20. Portions 13 and 14 join at a fold and perforation line 21. Portions 14 and 15 join at a fold line 22. Portions 15 and 16 join at a perforation line 23. Portions 13 and 16, as well as areas 17 and 18 on portion 11 all carry adhesive compositions provided for reasons to be set forth hereinafter.

Blank 2 in FIG. 1 is identical, except for its orientation, to blank 1 and, therefore, the portions of blank 2 carry the same numerals, except with prime signs added, as like portions on blank 1.

Blanks 1 and 2 can be formed of any suitable material, but will normally be formed from paper stock.

Figure 2:
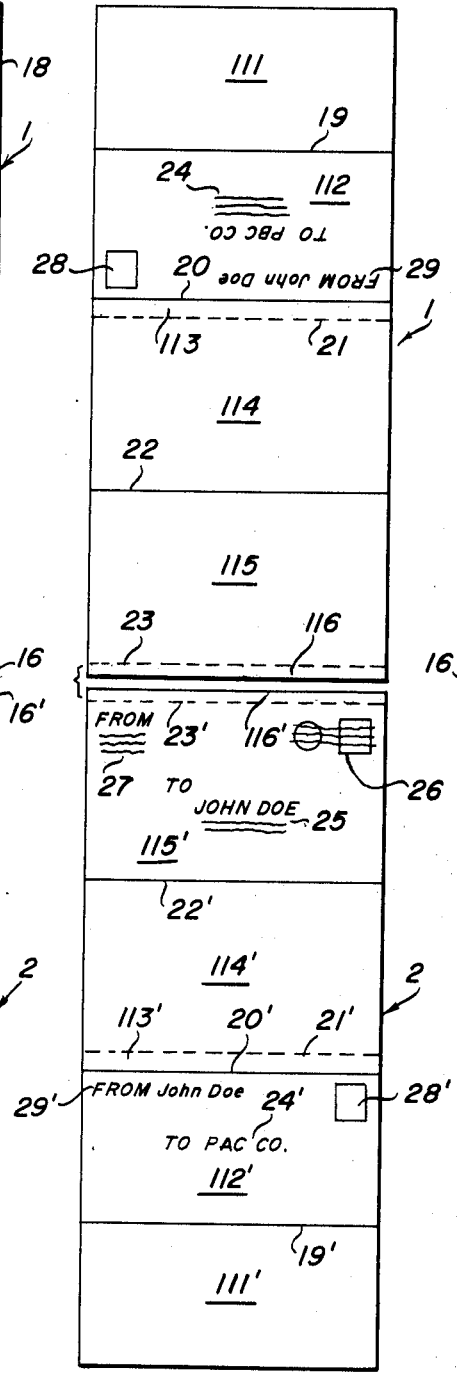
FIG. 2 is a plan view of the opposite sides of the pair of blanks of FIG. 1.

FIG. 2 shows the opposite sides of blanks 1 and 2 from the sides shown in FIG. 1. On blank 1, portions 111, 112, 113, 114, 115 and 116 denote the opposite sides, respectively, of the portions 11, 12, 13, 14, 15 and 16 shown in FIG. 1, while portions 111', 112', 113', 114', 115' and 116' denote the opposite sides, respectively, of the portions 11', 12', 13', 14', 15' and 16' in FIG. 1. Note that no adhesive is present on the sides of blanks 1 and 2 shown in FIG. 2.

Figure 3:
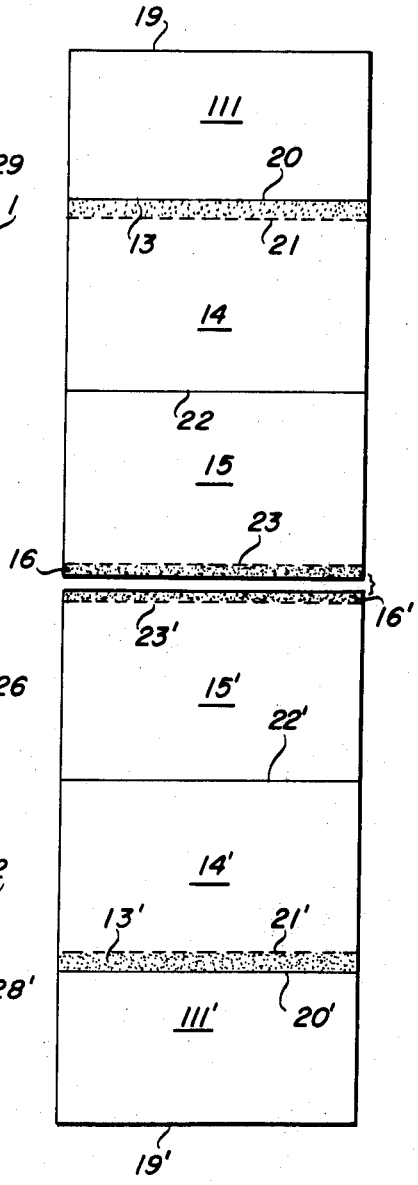
FIG. 3 is a plan view of the blanks as shown in FIG. 1 after the FIG. 1 blanks have each had an end folded over to form a pair of envelope pockets.

FIG. 3 shows the blanks of FIG. 1 after portion 11 has been folded about fold line 19 to be atop portion 12, and after portion 11' has been folded about fold line 19' to be atop portion 12'. The adhesive on 16, 16' and 17, 17' and 18, 18' can be of any suitable type, for example, water-activated or tacky types. The adhesive on areas 13 and 13' is preferably water-activated. At any rate before folding portions 11 and 11', as above described, the adhesive is already, or is treated to be, capable of bonding 17 and 18 to 12 and 17' and 18' to 12'. Once 17 and 18 are bonded to 12 and 17' and 18' are bonded to 12' two envelope pockets are formed.

Preferably while blanks 1 and 2 are still in flat, i.e. unfolded condition, advertising offerings and order forms are printed as desired on one or more portions 14, 15, 111, 114, 115, 14', 15', 111' and 114'. Also at the same or at another time, addresses, to be described, are printed on portions 112, 112' and 115'. The addressee information 24 on portion 112, as well as the advertising offerings and order forms on one or more of portions 14, 15, 11, 114 and 115 all relate to a first seller and his wares or services, and the addressee information on portion 112 includes an address chosen by the first seller to which his orders are to be returned. Similarly the address information 24' on portion 112', as well as the advertising and order forms on one or more of portions 14', 15', 111' and 114' all relate to a second seller and his wares or services, and the address information on portion 112' includes an address chosen by the second seller to which the second seller's orders are to be returned.

Figure 4:
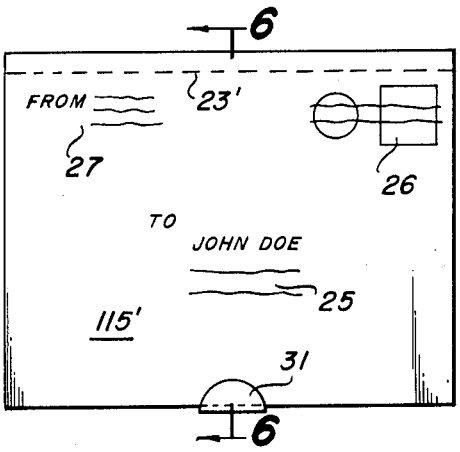
FIG. 4 is a plan view of the address side of the completed mailing assembly of FIGS. 1 to 3 shown as it would appear when ready for mailing.

Portion 115' is utilized to receive addressee information of a potential customer. Portion 115' is also utilized to carry outgoing postage, and a return address of either the first or second seller, or of any desired location chosen by the sellers. In FIGS. 2 and 4 the numerals 25, 26 and 27, respectively denote the addressee information, the postage, and the return address, just discussed.

Portion 112 is also utilized to receive return postage 28, and the return address 29 of a customer. Portion 112' is also utilized to receive return postage 28', and the return address 29' of a customer.

Blanks 1 and 2 may be printed at widely separate geographical locations, if desirable, since they are still separate blanks at this time.

Once separate blanks 1 and 2 are provided with all of the advertising offerings, order, address and postage information desired either by printing, or other means, and once 11 is folded and bonded by 17 and 18 to 12, and 11' is folded and bonded by 17' and 18' to 12', 1 and 2 are placed so that they are superimposed and coextensive, with area 16 immediately facing area 16' and portion 111 immediately facing portion 111'. At this juncture areas 16 and 16' are pressed together if tacky adhesive is employed, or wetted and pressed together if water activated adhesive is used so that 1 and 2 are formed into a unitary mailing assembly incorporating plural offer and return mailing pieces. In some instances it may be desirable to provide only one of areas 16, 16' with adhesive since to provide both areas with adhesive may be considered wasteful of adhesive.

My novel mailing assembly is not ready for mailing at this time, however. To prepare the assembly for mailing, portions 111 and 13 are first folded over about line 21 into engagement with portion 14, and portions 111' and 13' are folded over about line 21' into engagement with portion 14. Then all of blank 1 which now lies outboard of line 22 is folded about line 22 in such manner that portion 112 ends up in engagement with portion 15, and all of the blank 2 which now lies outboard of line 22' is folded about line 22' in such manner that portion 112' ends up in engagement with portion 15'. During the folding operations which take place after 16, 16' are bonded together lines 23, 23' act as hinges to allow such folding.

As an alternate to the procedure just described, blanks 1 and 2 can each be folded as described, while still separated, and then areas 16,16' can be bonded together to produce the same assembly as just described.

Figure 5:
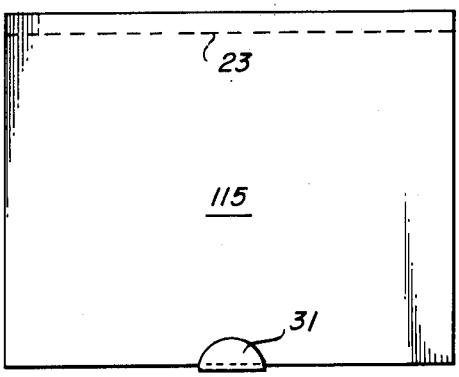
FIG. 5 is a plan view of the back side of the mailing assembly shown in FIG. 4.
Figure 6:
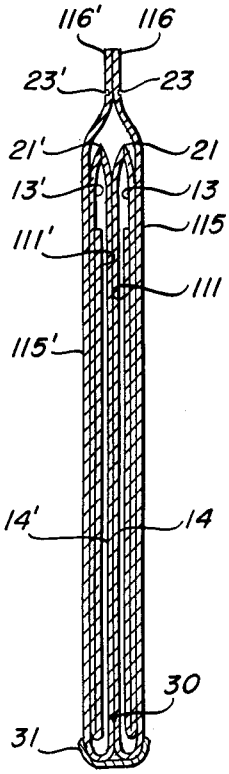
FIG. 6 is a cross-sectional view taken on the line 6—6 of FIG. 4.
Figure 8:
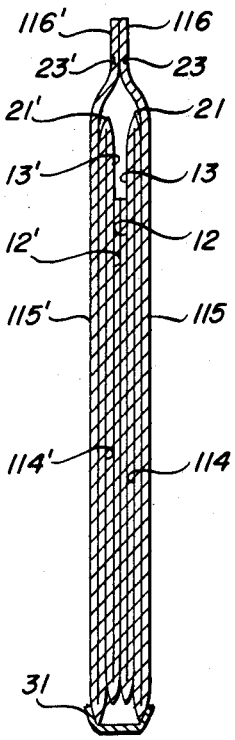
FIG. 8 is a cross-sectional view similar to FIG. 6, but showing an alternate way of folding the mailing assembly of FIGS. 4 and 5.

FIG. 6 shows in sectional view, except for a glue-spot 30, and an adhesive-backed sticker 31, both to be described, how the mailing assembly previously described appears in cross section when completely folded. When only minimal postal handling is expected during transit of one of my assemblies between sender and addressee only glue spot 30 is provided between portions 114 and 114', as shown, to hold the end of my mailing assembly opposite areas 116 and 116' together. However, if more severe in-transit handling is expected, an adhesive-backed sticker 31 bonded to portions 115 and 115' can be used in lieu of, or in addition to spot 30 for the same purpose. FIGS. 4 and 5 show external front and back views of the embodiment of my invention just described when ready for mailing.

It is understood that at least portions 14, 14', 15, 15', 111, 111', 114, 114' and 115 may be imprinted, or otherwise provided with advertising information and offers, order forms, and other information, as desired. Normally, portions 14, 15,111, 114 and 115 will have imprinted somewhere thereon, an order form, as well as advertising and other information pertaining to a seller identified by the addressee information on portion 112. Likewise portions 14', 15', 111' and 114' will normally have imprinted somewhere thereon an order form, as well as advertising and other information pertaining to a seller identified by the addressee information on portion 112'.

Figure 7:
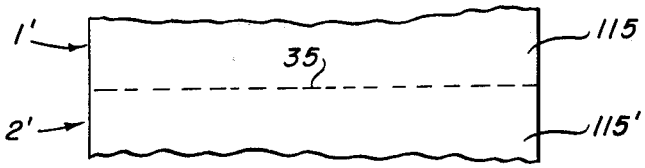
FIG. 7 is a plan view showing the central portion of a blank forming another embodiment of my invention.

Instead of making my envelope assemblies by utilizing initially separated blanks 1 and 2, I may make such assemblies utilizing only a single blank by having portions 115 and 115' initially united at a line of perforations 35 as shown in FIG. 7. The purpose of line 35 is to allow easy separation of 115 from 115' to thereby provide two separate mailing units denoted 1' and 2' in FIG. 7, when desired. This second embodiment of my invention is somewhat cheaper to manufacture than the first embodiment described since, for example, adhesive areas 16, 16' are not required.

Having now described two embodiments of my invention, the method of making and using each embodiment will be set forth. Beginning with the first embodiment, unfolded blanks 1 and 2 are first manufactured and provided with the various adhesive areas and fold and perforation lines described. The fold lines can either be represented by indicia, for example, an elongated printed line identified by adjacent indicia reading "FOLD LINE" (not shown) or by actual crease-forming lines identified by adjacent indicia reading "FOLD LINE" (not shown). The lines of perforations can be accompanied by adjacent indicia reading "SEPARATE HERE" (not shown). This fold and separation indicia has been omitted from the drawings to avoid confusion.

Next, or even concurrently with the blank manufacture already described, blanks 1 and 2 are printed, or otherwise provided with whatever address, postal, order and advertising information is desired. Now the blanks 1 and 2 are manipulated to and held in their FIG. 6 conformation by using glue spot 30 and/or sticker 31. The mailing assembly identified as my first embodiment is now either ready for mailing or can be readied for mailing merely by adding the appropriate postage in stamp or indicia form.

Upon receipt, the addressee may open my assembly by grasping portions 116, 116' with one hand and portions 115, 115' with another hand and pulling, which causes portion 116 to separate from the rest of blank 1 along line 23, and causes portion 116' to separate from the rest of blank 2 along line 23'. Further appropriate pulling ruptures glue spot 30 and/or sticker 31 thereby providing two separated offer and return units.

As noted previously the offers on one unit are normally for the goods or services of one seller, and the offers on the other unit are normally for the goods or services of another seller.

Let it be assumed that the recipient potential customer of one of my mailing assemblies desires to purchase some of the goods or services offered by the seller associated with what now remains of blank 1. Let it be further assumed that the order form for blank 1 is printed on portions 14 and 15, and that offers and advertising is printed on portions 111, 114 and 115. Such recipient has merely to detach portions 114 and 115 from portion 113 by tearing along perforated line 21, fill out and fold the order form comprised of portions 14 and 15 so that it will fit the envelope pocket bounded by 11, 12, 17, 18, 19 and 20; fold 13 over onto 111 and seal same thereto; and mail the now formed envelope back to the seller. Of course, if desired, a check or money order, or the like, can also be placed in the envelope pocket before the envelope is sealed and mailed.

If the recipient desires to also purchase some of the goods or services offered by the seller associated with what remains of blanks 2 he follows the same procedure as just described relative to blank 1, presuming that blank 2 has its order form printed on portions 14' and 15', and its offers and advertising printed on portions 111' and 114'.

The differences in making the second embodiment of my invention as shown in FIG. 7, compared to making the first embodiment just described have already been sufficiently discussed hereinabove, it is believed. After receipt by a recipient potential customer my second embodiment assembly is separated into two separate offer and return units 1' and 2' merely by tearing along line 35 and by rupturing spot 30 and/or sticker 31.

If the recipient desires to purchase goods or services offered on either 1' or 2', he may do so by following the same steps already set forth above relative to my first embodiment.

By predetermining the total pre-mailing weight of the mailing assembly of FIGS. 1 to 6 and 8, or the alternate embodiment of FIG. 7, it may be possible in many mailing situations to reduce overall postage costs by following the teachings set forth in my application Ser. No. 860,075 filed Dec. 13, 1977, now U.S. Pat. No. 4,184,628, regarding postage cost economies.

The term mailing piece as used in this application follows general postal parlance. That is, the word piece, although singular, should be construed as defining both single part and multiple part mail matter. By way of example, a postal card is a mailing piece, as is a separate letter sheet confined in an envelope.

Having now described two embodiments of my invention, what I claim and desire to secure by Letters Patent is:

1. A mailing assembly designed for initial mailing as an independent mailable unit comprising: a first send and return mailing piece including a first envelope and a first indicia-receptive portion attached to said first envelope; a second send and return mailing piece comprising a second envelope and a second indicia-receptive portion attached to said second envelope, said mailing assembly when in condition for initial mailing having at least parts of each of said first and second portions forming two exterior cover portions between which said envelopes are located, and means initially joining one of said cover portions to the other of said cover portions and allowing for subsequent manual detachment of said first mailing piece from said second mailing piece preparatory to subsequent remailing of at least portions of said first and second mailing pieces as separate mail items.

2. The combination of claim 1 wherein said indicia-receptive means are located wholly outside of the confines of said envelopes.

3. The combination of claim 2 wherein each of said indicia-receptive portions substantially encircles the envelope of which it is attached.

4. The combination of claim 2 wherein said envelopes engage each other.

5. The combination of claim 2, said means including spaced means.

6. The combination of claim 2, wherein portions of each of said envelopes engage the indicia-receptive portions to which they are attached at locations spaced from the locations of such attachments, and means at the attachment locations to aid in separation of said envelopes from their respective indicia-receptive portions.

7. The combination of claim 5, at least one of said spaced means including adhesive means.

8. The combination of claim 5, one of said spaced means including a frangible adhesive-including strip.

9. The combination of claim 5, said first and second indicia-receptive portions being initially integral with each other, and one of said spaced means including initially integral parts of said first and second portions which parts join each other to define a line of perforations.

10. The combination of claim 5, one of said spaced means including a rupturable glue spot.

11. The combination of claim 5, said spaced means including at least one line of perforations.

* * * * *